United States Patent [19]

Simpson et al.

[11] 4,422,286

[45] Dec. 27, 1983

[54] FIBER REINFORCED PLASTIC IMPREGNATED WIRE ROPE

[75] Inventors: Neville H. Simpson, Kenosha, Wis.; Peter P. Riggs, Ballaugh Glen, Isle of Man; Warren W. Rasmussen, Geneva, Ill.

[73] Assignee: AMSTED Industries Incorporated, Chicago, Ill.

[21] Appl. No.: 346,949

[22] Filed: Feb. 8, 1982

[51] Int. Cl.[3] ..... D07B 1/00; D07B 1/14

[52] U.S. Cl. ..... 57/221; 57/7; 57/217; 57/223; 57/258; 57/292

[58] Field of Search ..... 57/5, 7, 8, 210, 212, 57/213, 217, 218, 221, 223, 258, 292, 238, 902, 905, 907

[56] References Cited

U.S. PATENT DOCUMENTS

| | | | |
|---|---|---|---|
| 2,427,507 | 9/1947 | Powell et al. | 57/7 X |
| 2,509,894 | 5/1950 | Toulmin et al. | 57/221 X |
| 3,530,661 | 9/1970 | Thomen | 57/217 X |
| 3,800,522 | 4/1974 | Hughes et al. | 57/221 X |
| 3,824,777 | 7/1974 | Riggs | 57/217 X |
| 3,922,437 | 11/1975 | Kiita et al. | 57/223 X |
| 4,197,695 | 4/1980 | Hughes et al. | 57/221 X |

*Primary Examiner*—Donald E. Watkins

*Attorney, Agent, or Firm*—Edward J. Brosius; Fred P. Kostka

[57] ABSTRACT

Reinforced thermoplastic impregnated lubricated wire ropes are provided in the present invention. A method of reinforcing and filling the thermoplastic material with fibers, mineral fillers and powders is also provided.

28 Claims, 3 Drawing Figures

FIBER REINFORCED PLASTIC IMPREGNATED WIRE ROPE

FIELD OF THE INVENTION

This invention relates to thermoplastic or elastomer impregnated and lubricated wire ropes and more particularly to the reinforcing and filling of the thermoplastic or elastomeric material with discontinuous predispersed fibers, mineral fillers, or powders.

BACKGROUND OF THE INVENTION

The concept of reinforcing thermoplastic polymers or elastomers has produced an almost endless field of formulations. The most often used reinforcing polymer has been glass fiber, although higher performance fibers such as carbon and aramid have been gaining increased acceptance. Mineral reinforcements, although often regarded only as fillers or extenders, can improve certain properties of the base polymer. Reinforcers increase tensile strength when applied to a base resin and both reinforcers and fillers increase flexural modulus, with reinforcers offering greater increases. Impact properties in general will be increased by reinforcers. Both fillers and reinforcers will improve thermal properties, again with reinforcers offering greater increases.

Both reinforcers and fillers will lower the shrinkage of thermoplastics and elastomers thereby giving a more consistent material, however, reinforced thermoplastics shrink less in the direction of the flow than they do in the perpendicular direction. This property is termed anisotropic shrinkage.

It has been shown that there is minimum fiber length that would approach the degree of reinforcement afforded with a continuous system and yet not overly interfere with the moldability of the thermoplastic or elastomeric resin. One very important aspect of fiber size is the fact that laboratory tests of pressurized extrusion of a flexible thermoplastic between the outer strands of a rope have proven that for cross sections or wall thicknesses of the plastic that are less than 0.050 inch (1.27 mm) thick, "one dimension" reinforcement is approached because the thickness is less than the fiber length, creating forced alignment along the injection axis. Almost all the fibers are aligned in the flow direction giving 95% of the maximum reinforcement. This flow direction is perpendicular to the rope axis between the outer strands and then parallels said rope axis upon the plastic contacting the rope core. However, where wall thickness runs between 0.050 inch (1.27 mm) and 0.250 inch (6.35 mm) planar rather than one dimensional reinforcement is attained. This implies that half of the fibers are aligned in one direction and the other half are aligned in the perpendicular direction resulting in 50% of the maximum reinforcement obtained when all the fibers are aligned in direction of flow.

Tests on certain thermoplastics have shown that the tensile strength of the resin has been increased by more than 50% from 10,000 PSI to 16,000 PSI (704–1127 $Kg/cm^2$) by the addition of 5% fiberglass. Likewise, when the percent reinforcement has been increased to 5% or greater the Izod impact strength is increased by 50%; the flexural strength is increased by 22% and the flexural modulus is increased by 100%.

SUMMARY OF THE INVENTION

There are various types of plastic impregnated wire rope made for the purpose of improving fatigue life, reducing stresses, and inhibiting corrosion. Such ropes are disclosed in such U.S. Pat. Nos. as 3,824,777, 3,874,158 and 4,120,145. However, even greater benefits have been achieved by reinforcing the thermoplastic or reinforcing the elastomer with which the rope is impregnated.

The present invention provides a method for producing a well lubricated wire rope which is impregnated with a load bearing thermoplastic or elastomer such that the viscous lubricant is entrapped in the strands and core. The thermoplastic or elastomer is reinforced with discontinuous predispersed fibers, mineral filler or powders. Such mineral fillers and powders may include graphite or talcum. Further, the thermoplastic or elastomer may include a lubricating agent. The outside diameter of the plastic impregnated rope conforms to the outside diameter of the bare wire rope, or may extend beyond the outside diameter of the rope. The wire rope produced by this method usually has a smooth outer periphery with increased bearing area.

The present invention also provides a wire rope comprising a lubricated core including a central strand and a plurality of outer core strands wound therearound; a plurality of outer strands wound around said core, a flexible, reinforced thermoplastic resin or elastomer filling the spaces between the outer strands to retain the lubricant in the core and in the strands, wherein the outer diameter of the reinforced thermoplastic resin or elastomer conforms substantially to the outer diameter of the rope or beyond the outer diameter of the rope.

The present invention further provides a wire rope comprising a lubricated core including a central strand and a plurality of outer core strands wound therearound; a flexible reinforced thermoplastic or elastomer material filling the spaces between the outer core strands to retain the lubricant in the core, wherein the outer diameter of the reinforced thermoplastic or elastomer conforms substantially to the outer diameter of the core, and a plurality of strands wound around the core.

The plastic or elastomer impregnation of the wire rope of the present invention can be accomplished by pressurized extrusion of a flexible thermoplastic or elastomer into the interstices of the rope. During the pressurized extrusion, the fiber reinforcment or mineral filler is introduced at a concentration of 0 to 50% depending on the nature of the resin and the subsequent properties desired in the rope.

Impregnation of a lubricated wire rope with reinforced plastic or elastomer in accordance with the present invention significantly increases tensile strength of the wire rope, increases the flexural strength and flexural modulus of the wire rope, improves compression strength, inhibits entrance of foreign abrasive particles into the rope, prolongs the lubricant's life inside the rope and in addition forms a matrix that both supports and locks the individual strands in position relative to each other. The reinforced plastic or elastomer will permeate all of the spaces among the strands and the independent wire rope core will reduce the interstrand contact between the core and the outer strands and the mutual strand to strand contact. Furthermore, a well lubricated wire rope impregnated with reinforced plastic or elastomer while holding the outer strands spaced from each other, will have extremely good resistance to fatigue and an increased ultimate tensile strength because of the axial alignment of the fiber reinforcement and the reduction in internal strand contact, all while maintaining flexibility.

The present invention also provides for the addition of a powdered reinforcing agent to the plastic. The compressive strength of the plastic and thusly of the wire rope is increased by such addition.

The present invention further provides for the addition of a lubricating agent to the thermoplastic or elastomer. This lubricating agent will minimize internal friction, improve fatigue life and corrosion resistance for the wire rope.

It should be noted that the dimensions of the individual strands, the core, and the finished wire rope are the same as the corresponding dimensions of a standard rope without any coating. This is a very important consideration since most working ropes have to meet certain strength to size requirements as directed by machine/sheave configurations. Another advantage is a reduction in wire notching effect and internal friction because the load placed on the core strands are shared substantially equally by the spaced internal wires.

DESCRIPTION OF THE PREFERRED EMBODIMENT

Figure 1:
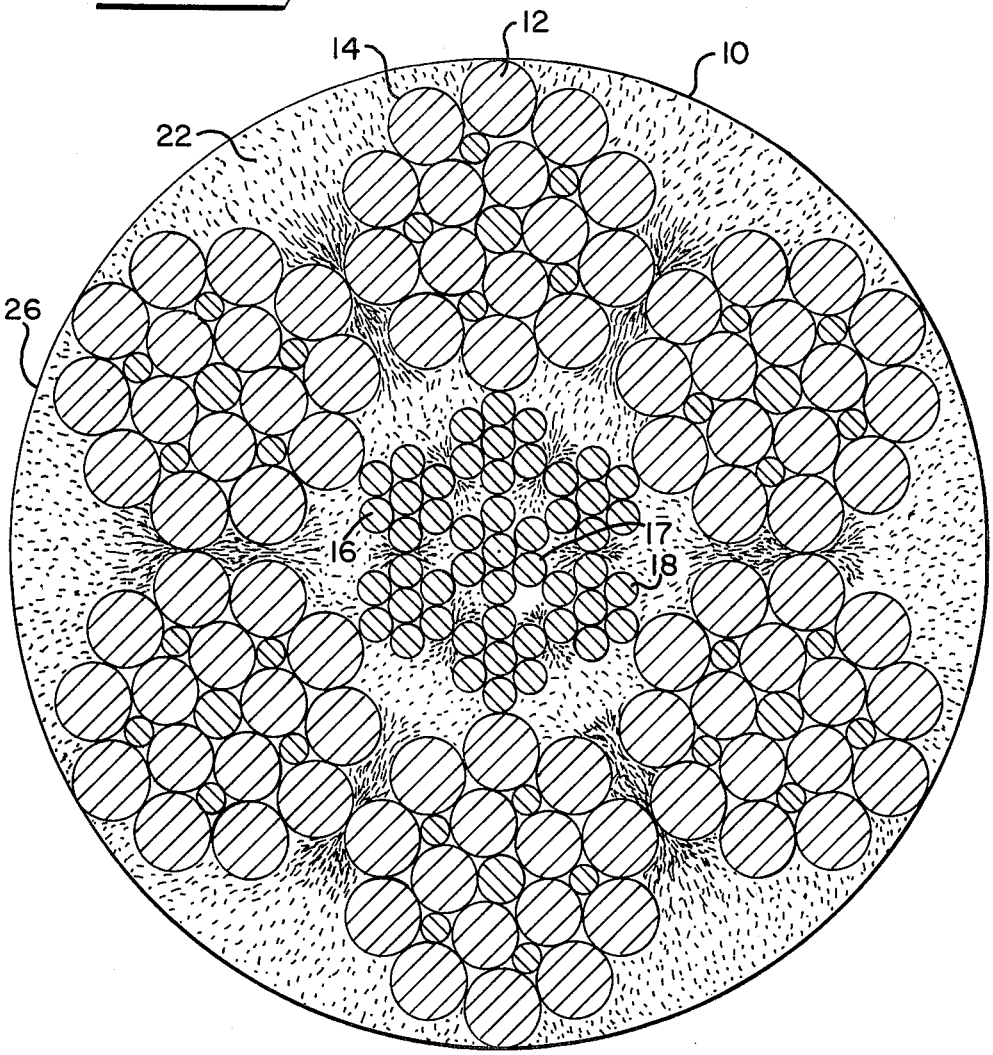
FIG. 1 is a cross sectional view of one embodiment of the reinforced plastic or elastomer impregnated wire rope of the present invention.

As shown in FIG. 1 the present invention comprises a conventional wire rope 10 wherein individual wires 12 are wound into strands 14, and a plurality of strands are wound about a core 16 which is also preferably formed of a central strand 17 and a plurality of outer core strands 18. It should be understood that the central strand 17 or the core 16 may be formed of a fiber material such as hemp instead of metallic wires as indicated in the drawing.

The manner of fabricating such a lubricated wire rope involves the winding of strands about the core, and the application of a lubricant to the core and the strands. The lubricated wire rope is then preheated to a temperature in the range of 100° to 300° F. (38° to 148° C.).

A flexible thermoplastic or elastomer 22 reinforced with either fibers, mineral fillers or powders is preferably extruded under pressure in the range of about 1500 to 5000 PSI (105 to 352 Kg/cm$^2$) and while holding the strands 14 spaced from each other, into the interstices between the strands 16 of the rope, but not extending outwardly beyond the outer diametrical limits of the rope 10 as indicated at 26. The reinforced thermoplastic can be any of those capable of being extruded such as polypropylene, polyurethane, polyethylene, nylon, PVC or tetrafluoroethylene. The reinforced elastomer may include rubbers such as nitrile or butyl. The reinforcing fibers can be any metallic or nonmetallic fiber with an optimum fiber diameter of 0.0004 inch (0.01 mm) to 0.005 inch (0.127 mm). The filler or powders can be organic or inorganic, metallic or nonmetallic. Further, the thermoplastic or elastomer may include a lubricant.

Figure 2:
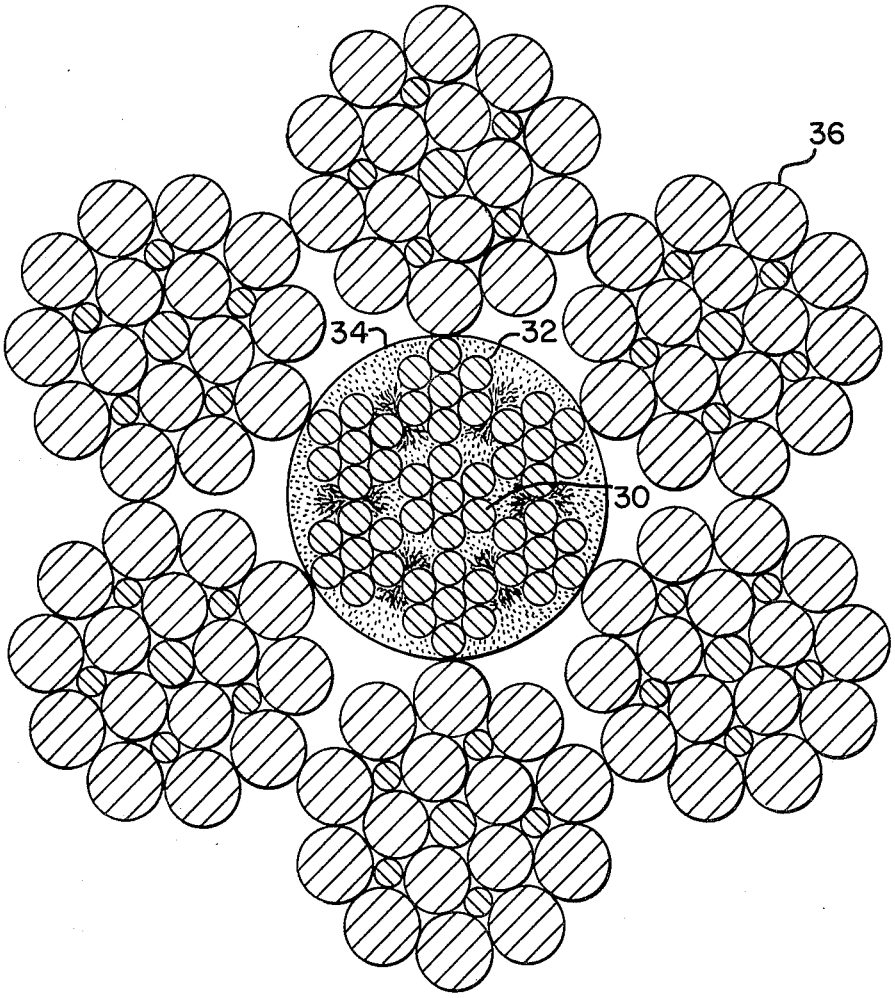
FIG. 2 is a cross sectional view of a second embodiment of the reinforced plastic or elastomer impregnated wire rope of the present invention.

A second embodiment of the wire rope of the present invention is shown in FIG. 2. A wire rope is shown wherein a central core strand 30 is surrounded by outer core strands 32. Central core strand 30 and outer core strands 32 usually are comprised of metallic wires, but may be comprised of fiber material. A flexible thermoplastic 34 reinforced with either fibers, mineral fillers or powders is preferably extruded about the core, and extends to the outer diametrical limits of the outer core strands 32. The plastic encapsulated core is then surrounded by outer strands, forming a wire rope.

Figure 3:
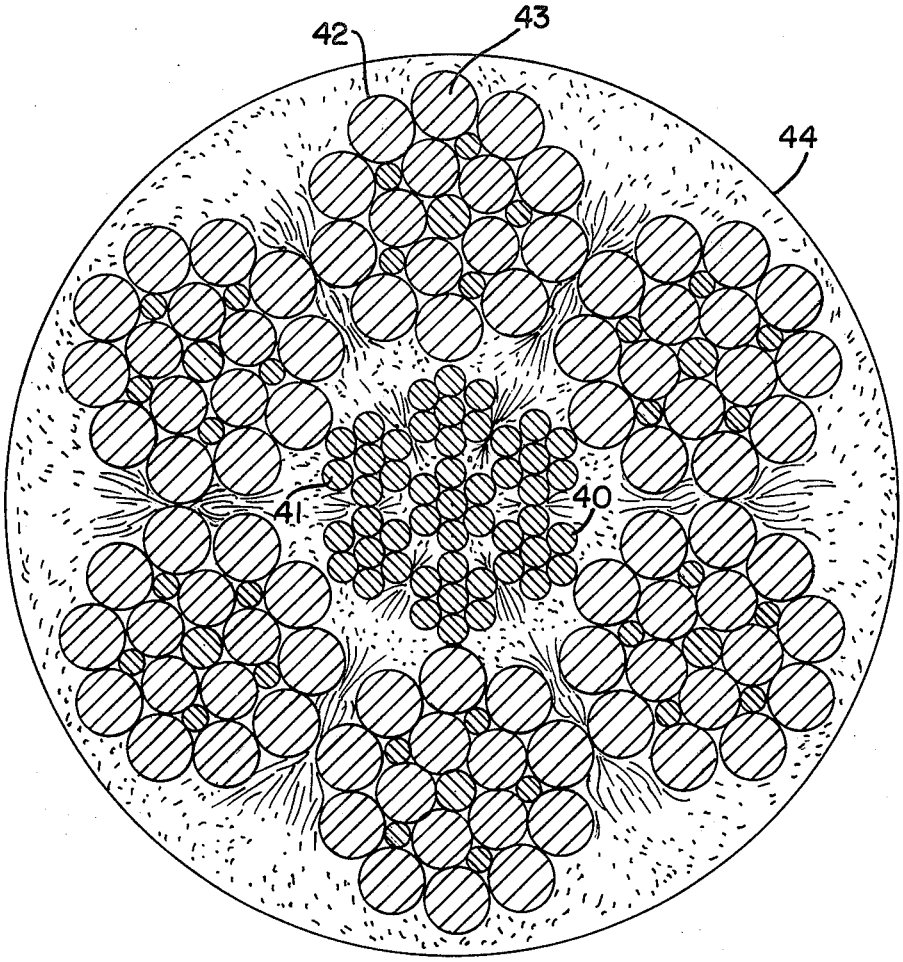
FIG. 3 is a cross sectional view of a third embodiment of the reinforced plastic or elastomer impregnated wire rope of the present invention.

A third embodiment of the wire rope of the present invention is shown in FIG. 3. A wire rope is shown wherein a central core 40 comprising individual strands 41 is surrounded by outer strands 42 comprising individual strands 43. Central core 40 and outer strands 42 usually are comprised of metallic wires, but may be comprised of fiber material. A flexible thermoplastic or elastomer 44 reinforced with either fiber, mineral fillers or powders is preferably extruded into the rope, and extends beyond the outer diametrical limits of outer strands 42.

What is claimed is:

1. A method of making a wire rope comprising the steps of:

winding individual wires into strands; forming a plurality of outer strands about a lubricated core into a multistrand rope while coating the outer strands with a lubricant; and impregnating the rope with a coating reinforced with discontinuous predispersed fibers, said coating extending between said core and said outer strands and between said outer strands.

2. The method of claim 1, wherein the coating is a thermoplastic resin.

3. The method of claim 1, wherein the coating is an elastomer.

4. The method of claim 1, wherein the rope is preheated to a temperature in the range of 100° to 300° F. (38° to 148° C.) prior to coating.

5. The method of claim 1, wherein the coating is further reinforced with powdered materials.

6. A method of making a wire rope comprising the steps of:

winding individual wires into strands; forming a plurality of outer strands about a lubricated core into a multistrand rope while coating the outer strands with a lubricant; and impregnating the rope with a coating reinforced with mineral fillers, said coating extending between said core and said outer strands and between said outer strands.

7. The method of claim 6, wherein the coating is a thermoplastic resin.

8. The method of claim 6, wherein the coating is an elastomer.

9. The method of claim 6, wherein the rope is preheated to a temperature in the range of 100° to 300° F. (38° to 148° C.) prior to coating.

10. The method of claim 6, wherein the coating is further reinforced with powdered materials.

11. A wire rope comprising a lubricated core including a central strand and a plurality of outer core strands wound therearound; a plurality of outer strands wound around said core, and a coating reinforced with discontinuous predispersed fibers filling the spaces between the core and outer strands to retain the lubricant in the core and in the strands.

12. The rope of claim 11, wherein the outer diameter of the coating extends substantially to the outer diameter of the outer rope strands.

13. The rope of claim 11, wherein the outer diameter of the coating extends beyond the outer diameter of the outer rope strands.

14. The rope of claim 11, wherein the coating is a thermoplastic resin.

15. The rope of claim 11, wherein the coating is an elastomer.

16. The rope of claim 11, wherein the coating contains lubricants.

17. The rope of claim 11, wherein the coating is further reinforced with powdered materials.

18. The rope of claim 11, wherein the outer diameter of the coating is less than the outer diameter of the outer rope strands.

19. The rope of claim 11, wherein the core is an independent wire rope core.

20. A wire rope comprising a lubricated core including a central strand and a plurality of outer core strands wound therearound; a plurality of outer strands wound around said core, and a coating reinforced with mineral fillers filling the spaces between the core and outer strands to retain the lubricant in the core and in the strands.

21. The rope of claim 20, wherein the outer diameter of the coating extends substantially to the outer diameter of the outer rope strands.

22. The rope of claim 20, wherein the outer diameter of the coating extends beyond the outer diameter of the outer rope strands.

23. The rope of claim 20, wherein the coating is a thermoplastic resin.

24. The rope of claim 20, wherein the coating is an elastomer.

25. The rope of claim 20, wherein the coating contains lubricants.

26. The rope of claim 20, wherein the coating is further reinforced with powdered materials.

27. The rope of claim 20, wherein the outer diameter of the coating is less than the outer diameter of the outer rope strands.

28. The rope of claim 20, wherein the core is an independent wire rope core.

* * * * *